US005243328A

United States Patent [19]

Lee et al.

[11] Patent Number: 5,243,328

[45] Date of Patent: Sep. 7, 1993

[54] ELECTRONIC EQUIPMENT ANTI-THEFT MONITORING SYSTEM

[76] Inventors: Jung K. Lee; Yong H. Lee, both of 2209 Old Bosley Rd., Timonium, Md. 21093

[21] Appl. No.: 729,198

[22] Filed: Jul. 12, 1991

[51] Int. Cl.[5] ..... G08B 13/14

[52] U.S. Cl. ..... 340/568; 340/310 CP; 340/538

[58] Field of Search ..... 324/511, 527; 340/568, 340/687, 286.07, 286.08, 286.11, 538, 310 CP; 455/3.3, 3.1, 6.3; 307/3

[56] References Cited

U.S. PATENT DOCUMENTS 3,553,674 10/1968 Head ..... 340/652
3,633,199 1/1972 Curry ..... 340/538
4,121,201 10/1978 Weathers ..... 340/568
4,695,788 9/1987 Marshall ..... 324/527

*Primary Examiner*—Jin F. Ng
*Assistant Examiner*—Christine K. Oda

[57] ABSTRACT

A power distribution and anti-theft alarm system for monitoring a plurality of electronic equipment utilizes existing front-end noise suppressor capacitors to provide a return path along the power supply lines of an injected RF current back to the system monitoring. Accordingly, removal or cutting of the power supply cords to the various electronic equipment can be monitored to provide a theft deterrent. Corresponding LEDs are utilized to provide status of the various channels coupled to the power distribution and anti-theft alarm system. Accordingly, power on/off, alarm on/off and electronic equipment status is indicated.

20 Claims, 13 Drawing Sheets

| | Ch1 | Ch2 | Ch3 | Ch4 | Ch5 | Ch6 | Ch7 | Ch8 |
|---|---|---|---|---|---|---|---|---|
| WAVE 1 | | | | | | | | |
| | | | | | | | | |
| WAVE 2 | | | | | | | | |
| | | | | | | | | |
| WAVE 3 | | | | | | | | |
| | | | | | | | | |
| WAVE 4 | | | | | | | | |

FIG. 7

ELECTRONIC EQUIPMENT ANTI-THEFT MONITORING SYSTEM

BACKGROUND OF THE INVENTION

1. Field of the Invention

The present invention relates to an electronic equipment anti-theft monitoring system. More specifically, the present invention relates to a system, device and method for selectively monitoring electronic equipment by injecting an RF current into the power supply lines of the electronic equipment and monitoring return of the injected RF current through a front-end noise suppressor capacitor mounted across the power supply lines within the electronic equipment.

2. Description of the Background Art

Due to the rapid evolution in electronic technology, the majority of electronic devices presently used comprise complex circuits, such as switching power supplies for example, which emit radio signals as noise. To eliminate the radio signal noise within the device, front-end noise suppressor capacitors are commonly installed in parallel across the power supply lines to eliminate pulse and various noises generated by the complex circuitry and noise which originates externally of the device which may contribute to device malfunction. For instance, computers, monitors, printers, televisions and VCRs which accommodate a switching power supply normally utilize a front-end noise suppressor capacitor to eliminate the above-mentioned noises.

Normally, the front-end noise suppressor capacitors are of large capacity in the range of 0.05μF–1.00μF to suppress a wide frequency range of radio signals. Accordingly, the front-end noise suppressor capacitors are normally disposed in the circuit before the power switch of the electronic equipment in order to protect the contact points of the power switch from sparks and to also eliminate any generated noise. Generally, if noise is sent through one side of the power supply line from external the electronic device, the frontend noise suppressor capacitor serves to return the noise to its source through the other side of the power supply line.

SUMMARY OF THE INVENTION

Accordingly, it is a primary object of the present invention to provide an electronic equipment anti-theft monitoring system which injects RF current into the power supply lines of the electronic equipment and which utilizes existing front-end noise suppressors to provide a return path for the injected RF current and to thereafter monitor the returned injected RF current. It is a further object of the present invention to provide a power distribution and alarm system which supplies power to and provides anti-theft monitoring of electronic equipment using existing front-end noise suppressors of the electronic equipment.

Yet another object of the present invention is to provide a unitary housed power distribution and alarm system for supplying power to and providing anti-theft monitoring of a plurality of electronic equipment over a plurality of channels utilizing existing front-end noise suppressors of the electronic equipment.

A still further object of the present invention is to provide an electronic equipment anti-theft monitoring system for use with electronic equipment which does not include front-end noise suppressors.

These and other objects of the present invention are fulfilled by providing a power distribution and alarm system which includes an RF generator which generates an RF current, and a power distribution circuit, coupled to the RF generator, for supplying power along power supply lines to the electronic equipment, wherein the RF current is injected into the power supply lines. Furthermore, a detection circuit is coupled to the power supply lines to detect the injected RF current returned from front-end noise suppressors mounted across the power supply lines within the electronic equipment. Thereafter, an alarm circuit is coupled to the detection circuit and generates an alarm signal indicative of disconnect of the power supply lines from the electronic equipment when the return injected RF current is not detected by the detection circuit.

The above-noted power distribution and alarm system can be unitarily housed to provide anti-theft monitoring of a plurality of electronic equipment over a plurality of channels.

The electronic equipment anti-theft monitoring system, as noted above, can be used to monitor electronic equipment which does not include existing front-end noise suppressors. The monitoring can be provided by coupling an RF current return device to a front-end of the electronic equipment, in parallel across power distribution lines, to provide a return path for the injected RF current.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIG. 7 illustrates a waveform chart useful in describing the generation of signals and operation of the multiplexer/RF detector block, alarm switch/clock block and the comparison block;

DETAILED DESCRIPTION OF THE PREFERRED EMBODIMENTS

Figure 1:
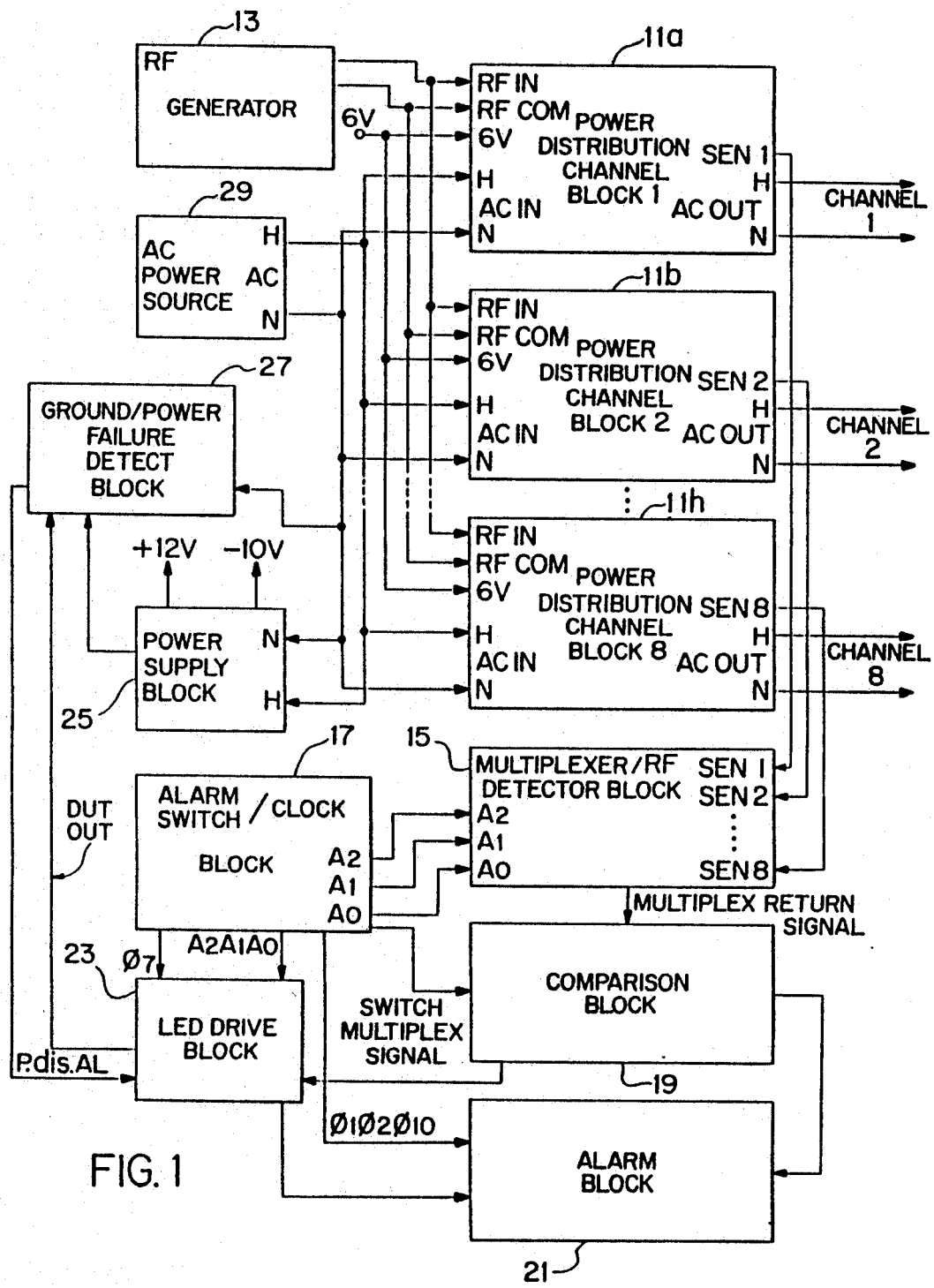
FIG. 1 illustrates in general block diagram form the power distribution and anti-theft alarm system according to an embodiment of the present invention.

FIG. 1 generally illustrates a preferred embodiment of the power distribution and anti-theft alarm system of the present invention. The various elements illustrated are shown in greater detail in FIGS. 2-11.

As illustrated in FIG. 1, power distribution is provided by a plurality of power distribution channel blocks 1-8, denoted respectively as 11*a*-11*h*. Each of the power distribution channel blocks is coupled to an RF generator 13 through terminals RF IN and RF COM. Furthermore, each of the power distribution channel blocks is coupled to a 6v dc input for biasing purposes and an ac power source 29 through AC in terminals H and N. The power distribution channel blocks each provide ac power to various electronic equipment along channels 1-8 through AC out terminals H and N. The power distribution channel blocks further provide sensing outputs SEN 1-8 to multiplexer/RF detector block 15.

Briefly, the electronic equipment to be monitored includes standard front-end noise suppressor capacitors mounted therein in parallel across the power supply lines. The RF generator 13 generates RF current which is injected into the power supply lines within the power distribution channel blocks. Return of the injected RF current through each of channels 1-8 through the front-end noise suppressor capacitors of the electronic equipment back to the power distribution channel blocks is sensed within the power distribution channel blocks. Sensing outputs SEN 1-8 are thereafter generated by the power distribution channel blocks indicative of return injected RF current.

Within the multiplexer/RF detector block 15, signals SEN 1-8 are received from the power distribution channel blocks and thereafter multiplexed to generate a multiplex return RF signal. The multiplex return RF signal is thereafter amplified and output from the multiplexer/RF detector block 15.

The power distribution and anti-theft alarm system of FIG. 1 further includes alarm switch/clock block 17. A plurality of switches are provided equal to in number of the channels which are to be monitored by the system. The switches generate, upon activation, signals indicative of the channels which are to be monitored for anti-theft. The signals are thereafter multiplexed to form a switch multiplex signal. The alarm switch/clock block 17 further generates a system clock consisting of various phases $\phi 0$-$\phi 7$, $\phi 11$ and $\phi 12$ and further sequences the 3-bit addresses of the various channels, in this case eight channels, at roughly 20Hz with signals A0-A2 through the corresponding address lines. Multiplexer/RF detector block 15 utilizes the address signals A0-A2 to synchronize multiplexing of the signals SEN-1-8.

Comparison block 19 serves to compare the switch multiplex signal output from alarm switch/clock block 17 with the multiplex return RF signal generated by multiplexer/RF detector block 15. The comparison therein essentially provides indication of which of the channels monitored for anti-theft includes a return path for the injected RF current through the corresponding front-end noise suppressor capacitors of the electronic equipment.

An alarm signal is thereafter generated and output from the comparison block 19 and is indicative of which of the monitored channels are secure with respect to the presence of the electronic equipment. The comparison block 19 provides an alarm signal to the alarm block 21 and control signals to LED drive block 23. Upon activation of the alarm of the alarm block 21, an internal piezo speaker is activated as well as an external relay. A loud two-tone sound is generated for the alarm and a soft intermittent beep is generated as a result of a power failure. As will be described forthcoming, the system operates during power failure.

Figure 13:
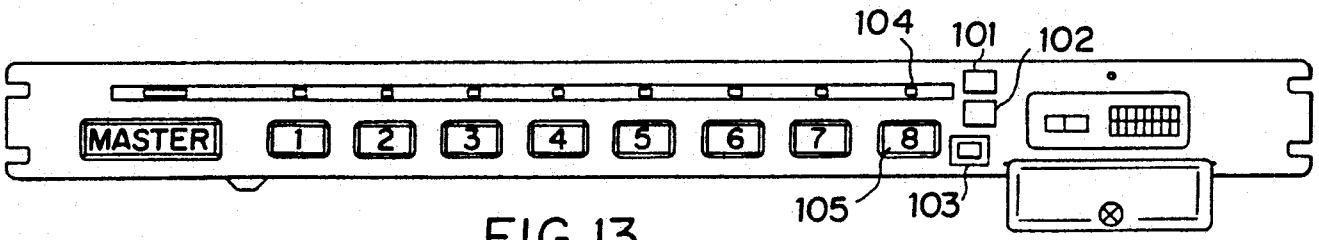
Figure 14:
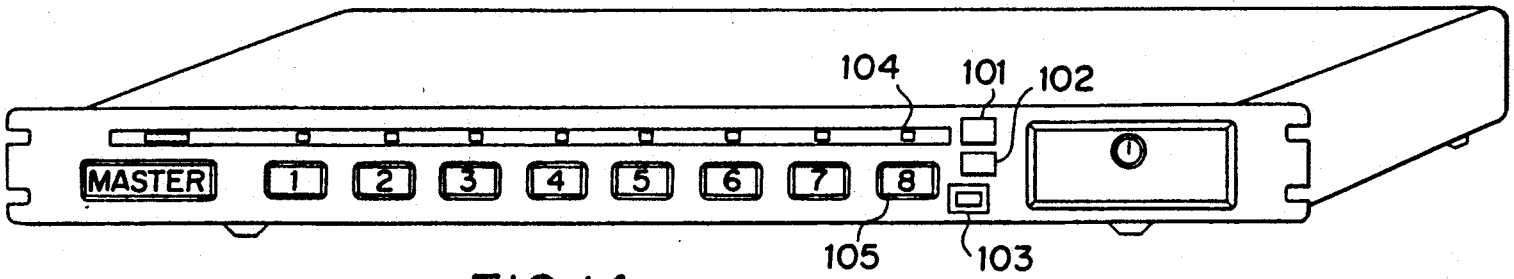
Figure 15:
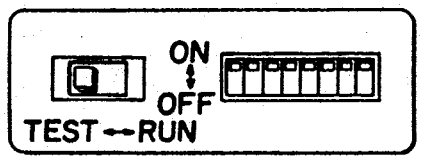

The LED drive block 23 functions to drive the LEDs of the front panel of the power distribution and anti-theft alarm system housing, as illustrated in FIGS. 13 and 14. The LED drive block 23 is accordingly coupled to ground/power failure detect block 27 which is in turn coupled to power supply block 25 and the neutral line of ac power source 29. Ground/power failure detect block 27 operates to sense the ground line in order to detect the removal of the alarm system itself and also to provide indication of power failure to provide control signals to the LED drive block.

Based upon the above-noted control signals, the LED drive block 23 drives the three color LEDs 104 of the front panel of the power distribution and anti-theft alarm system housing illustrated in FIGS. 13 and 14. As an example of the manner in which the LEDs are utilized to indicate alarm conditions, Table 1 is referenced. As noted in Table 1, an inactive state of the LEDs indicates that the particular channel is not presently monitored for anti-theft, or in other words the alarm is not activated or is off. In this condition, the corresponding switch of the alarm switch/clock block 17 of FIG. would be in the off position. Furthermore, in this particular instance, the power supply switch 105, located on the front panel of the housing as illustrated in FIGS. 13 and 14, for the particular electronic equipment is off and power is not supplied thereto through the particular channel. Accordingly, the status of the electronic equipment is not monitored and is therefore unknown.

TABLE 1

| LED | ALARM | POWER | ELECTRONIC EQUIPMENT STATUS |
|---|---|---|---|
| No light | OFF | OFF | X |
| Blue | OFF | ON | X |
| Red Flash | ON | OFF | SECURE |
| Red Flash with blue | ON | ON | SECURE |
| Yellow | ON | X | ALARM |

A constant blue illumination of an LED of a particular channel indicates that the particular channel is not being monitored for anti-theft and that the corresponding power supply switch 105 is on and the particular channel is supplied with power. Since the alarm is not activated, the status of the electronic equipment is not monitored and is therefore unknown. Red flashing of the LED for a particular channel indicates that the particular channel is monitored for anti-theft, or in other words the alarm has been activated by virtue of activation of the particular switch of the alarm switch/-clock block 17 for the given channel. Furthermore, in this particular instance, power is not supplied to the electronic equipment since the corresponding power supply switch 105 is not activated. The status of the electronic equipment is secure as indicated.

Alternating red and blue flashing of an LED for a particular channel indicates that the alarm system for the particular channel is activated and power is supplied to the corresponding electronic equipment. In this instance, the status of the electronic equipment is secure. Finally, yellow illumination of an LED for a particular channel indicates that the alarm is activated and that supply of power to the particular electronic equipment is indeterminent. That is, the electronic equipment has been removed from the corresponding output terminal of the power distribution and anti-theft alarm system or the power supply cord has been tampered with. The resultant status of the particular channel is that of alarm status. In this condition, an internal piezo speaker of the alarm block 21 and an external relay may be activated.

Finally, power supply block 25 of the power distribution and anti-theft alarm system of FIG. 1 serves to provide a +12v source and a −10v source, derived from the +12V source, for the system. A back-up power supply is also provided by the power supply block.

As the elements and operation of the power distribution and anti-theft alarm system as illustrated in FIG. 1 have been generally described as set forth above, the following description provides a more specific description of the individual elements of the system as shown in FIG. 1.

Figure 2:
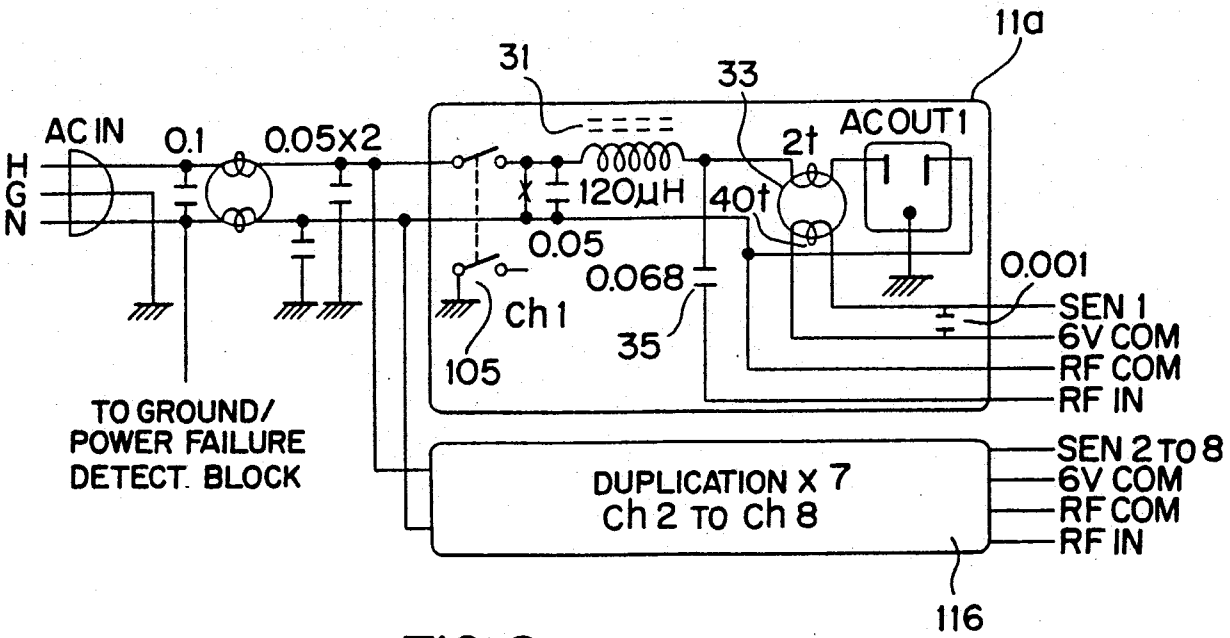
FIG. 2 illustrates the specific details of a power distribution channel block of FIG. 1.

FIG. 2 illustrates the specific details of power distribution channel block 11*a* of channel 1 of FIG. 1. It is noted that the remaining power distribution channel blocks are configured similarly. Power supply switch 105 is illustrated at the front end of the block. The injected RF current indicated as RF IN is injected through injector capacitor 35. Injector capacitor 35 is preferably a 0.068μF capacitor and is coupled between the primary two turn coil of toroid coil 33 and RF choke 31. RF choke 31 preferably is comprised of a 120μH inductor which serves to prevent the 120KHz injected RF current from passing towards the ac power source 29. The primary two turn coil of the toroid coil 33 serves to couple the injected RF current with the H line from ac power source 29. The coupled injected RF current and ac power is thereafter supplied to the electronic equipment of the particular channel through outlet AC OUT1 as illustrated.

Toroid coil 33 further is comprised of a 120KHz resonant 40 turn secondary coil coupled on one end to the 6v input terminal of the corresponding power distribution channel block and provides as an output via its second line the corresponding sensing output SEN1. Coupled across the 40 turn secondary coil is a 0.001μf capacitor. Essentially, the existence of return injected RF current of a particular electronic equipment of the monitored channel is sensed by virtue of determining if a complete return path is provided back through the front-end noise suppressor capacitor of the particular electronic equipment. In order to sense the existence of such a return path, the secondary 40 turn coil of the toroid coil 33 senses whether or not a current exists in the ac power source line H of the particular power distribution channel block. If the power cord of the electronic equipment is disconnected from outlet AC OUT1 or is cut, no current exists in ac power source line H, and therefore, no current is generated in the 40 turn secondary coil of toroid coil 33. Accordingly, by sensing line H of the ac power source within the power distribution channel block through the use of the 40 turn secondary coil of the toroid coil 33, sensing output SEN1 is selectively generated.

Figure 3:
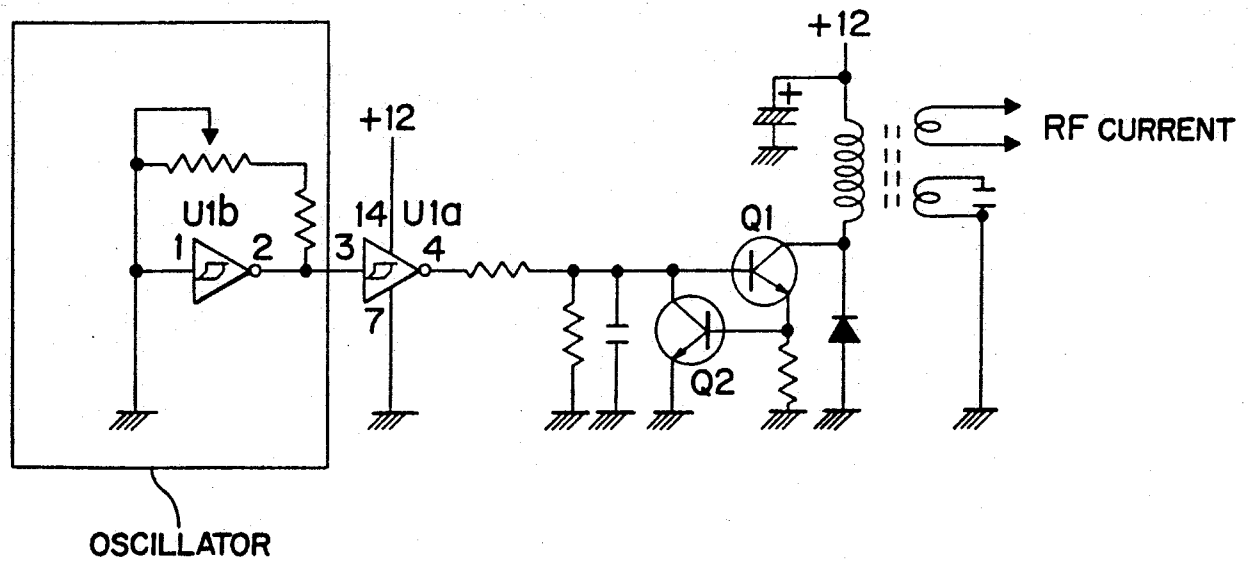
FIG. 3 illustrates the specific details of the RF generator of FIG. 1.

FIG. 3 illustrates in detail RF generator 13 of FIG. 1. Schmitt trigger U1*b* serves to generate the oscillated RF signal which is subsequently buffered in Schmitt trigger U1*a* and then amplified by transistor Q1. The amplified signal is then provided as RF injector current through terminals RF OUT. The use of the Schmitt triggers provides a very stabilized frequency output.

Figure 4:
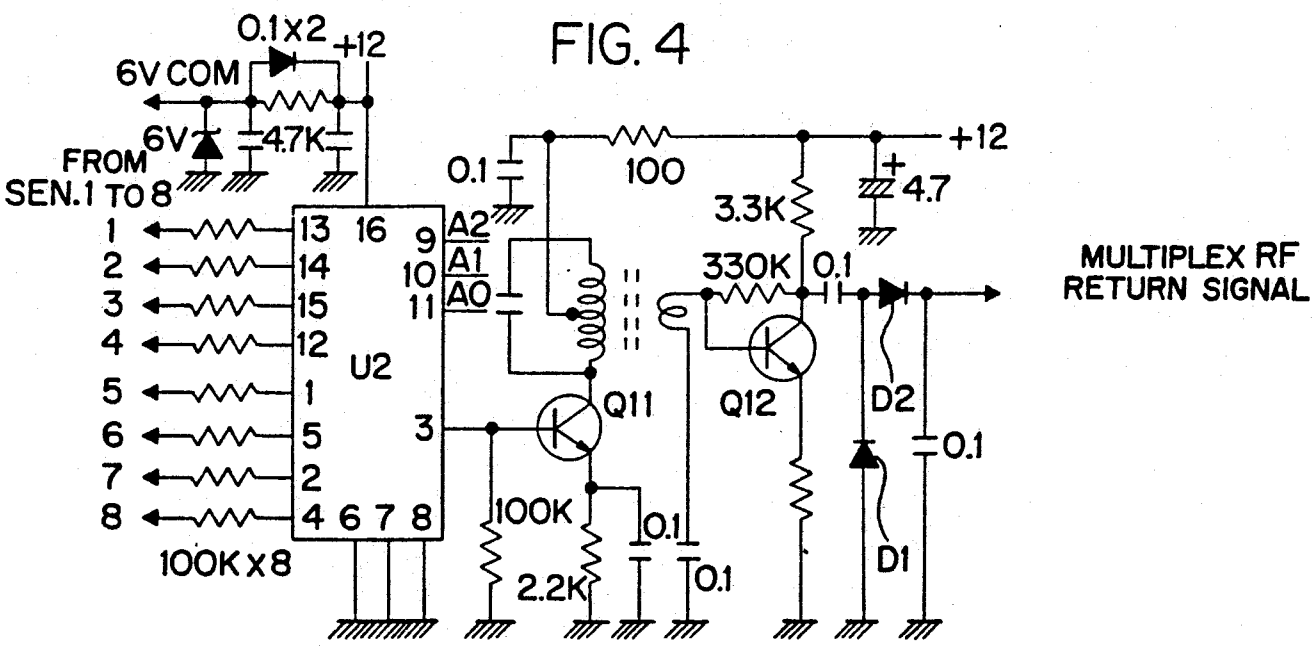
FIG. 4 illustrates the specific details of the multiplexer/RF detector block of FIG. 1.

FIG. 4 illustrates in detail multiplexer/RF detector block 15 of FIG. 1. As illustrated, the plurality of sensing outputs SEN1–8 generated by the power distribution channel blocks are provided as input to multiplexer logic chip U2. Input to multiplexer logic chip U2 are address signals A0–A2 as generated by alarm switch/-clock block 17 of FIG. 1. The address signals A0–A2 are utilized to aid in generating a multiplex signal output of pin 3 of multiplexer logic chip U2. Thereafter, the multiplex output signal is amplified by amplifiers Q11 and Q12 and detected by diodes D1 and D2 to provide the multiplex return RF signal as illustrated in FIG. 4. The multiplex RF return signal is a dc waveform which may take a form similar to waveform 1 as illustrated in FIG. 7.

Figure 5:
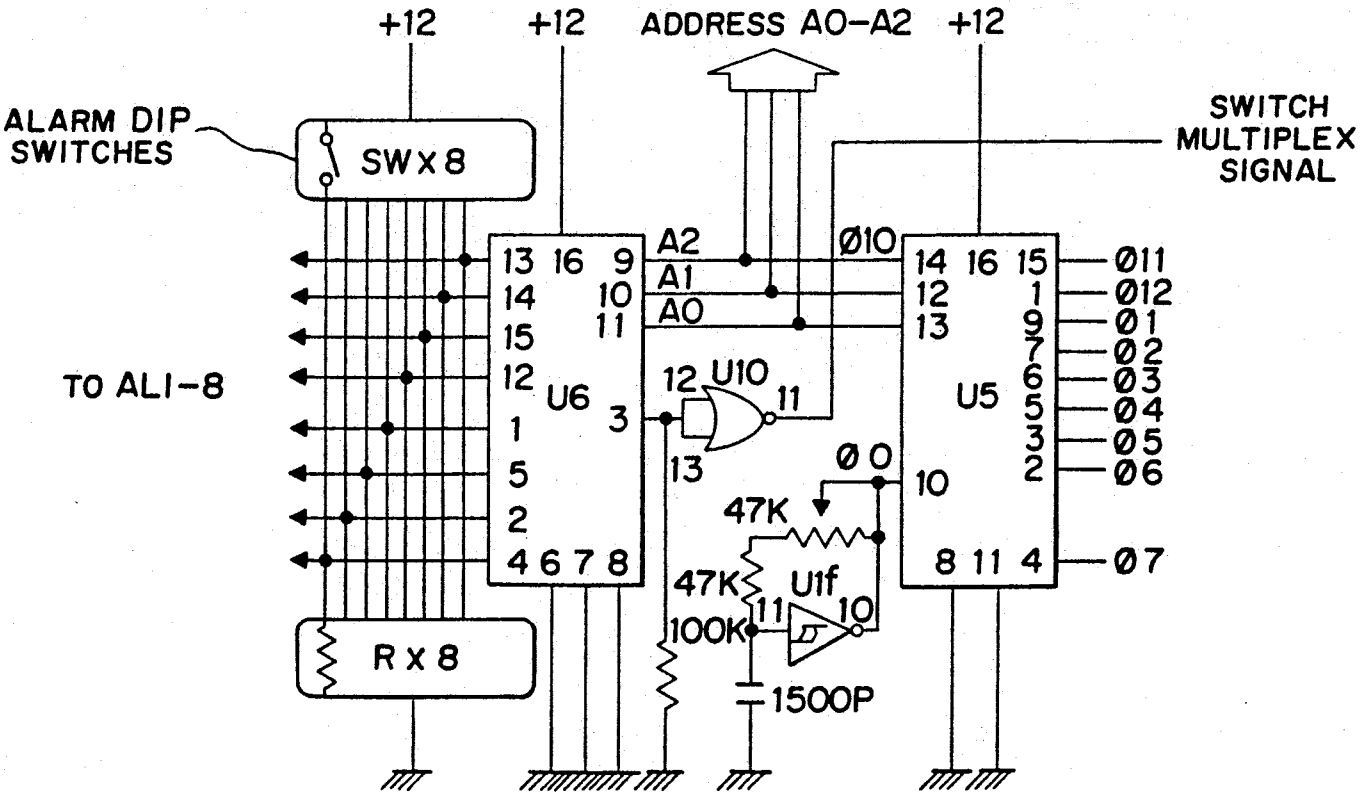
FIG. 5 illustrates the specific details of the alarm switch/clock block of FIG. 1.

Alarm switch/clock block 17 is illustrated in specific detail in FIG. 5. In order to avoid the complexity of duplicate parts when increasing channel capability of the power distribution and anti-theft alarm system, clock logic chip U5 is utilized. Clock logic chip U5 sequences the 3-bit addresses, in this particular embodiment, at approximately 20Hz via address signals A0–A2 through the corresponding address lines. The address signals A0–A2 are supplied to the multiplexer/RF detector block 15 and the LED drive block 23 for address synchronization. Clock logic chip U5 furthermore generates clock outputs of phase $\phi 0$–$\phi 7$, $\phi 11$ and $\phi 12$ as a system clock.

Alarm switch/clock block 17 of FIG. 5 further includes switches coupled to multiplexer logic chip U6. As mentioned previously, activation of the various switches, such as DIP switches for example, indicates the particular channels to be monitored for anti-theft. Multiplexer logic chip U6 is tied to address signals A0-A2 through the corresponding address lines which are utilized to aid in generating a multiplexed output signal at terminal 3 indicative of the status of the corresponding switches. The corresponding multiplexed output signal is inverted by inverter U10 to provide the switch multiplex signal as illustrated. The switch multiplex signal is a dc waveform which may take a form similar to waveform 2 as illustrated in FIG. 7. The corresponding signal is thereafter supplied to comparison block 19 as illustrated in FIG. 1.

Figure 6:
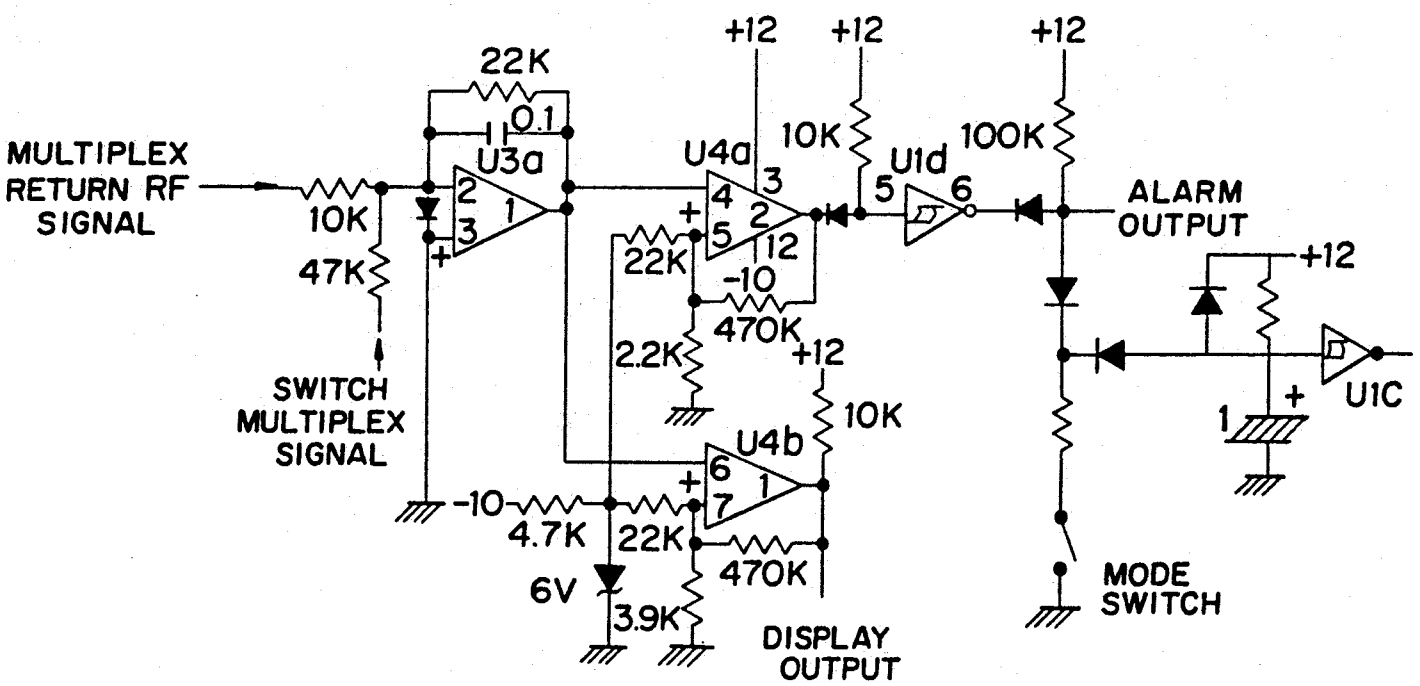
FIG. 6 illustrates the specific details of the comparison block of FIG. 1.

Comparison block 19 of FIG. 1 is illustrated in detail in FIG. 6. As illustrated, the multiplex return RF signal from multiplexer/RF detector block 15 is coupled to 10K resistor R1. Additionally, the switch multiplex signal from alarm switch/clock block 17 is supplied to 47K resistor R2. The combined signal is thereafter input to op-amp U3*a* to be supplied to comparators U4*a* and U4*b*. The value of resistor R2 is selected so as to ensure that op-amp U3*a* does not operate in saturation. In order to ensure maximum reliability of the comparison block, the two comparators U4*a* and U4*b* have slightly different threshold levels. The threshold level for the LED comparator, U4*b*, is slightly lower than the threshold for the alarm comparator, U4*a*. Subsequently, the alarm output signal is provided to alarm block 21 and the display output signal is output to LED drive block 23.

The generation of the corresponding output signals and operation of multiplexer/RF detector block 15, alarm switch/clock block 17 and comparison block 19 is as illustrated in the waveform chart of FIG. 7. As illustrated, for instance, if the electronic equipment of respective channels 2, 4 and 7 were plugged into the corresponding outlets AC OUT2, AC OUT4 and AC OUT7 of the corresponding power distribution channel blocks, the return injected current would be sensed by the corresponding power distribution channel blocks to provide as output sensing outputs SEN2, SEN4 and SEN7. The corresponding multiplex return RF signal would accordingly take the form of waveform 1 as illustrated in FIG. 7. If channels 4 and 7 were designated as to be monitored for anti-theft by activation of the switches of alarm switch/clock block 17 of FIG. 5, the switch multiplex signal would take the form of waveform 2 as illustrated in FIG. 7. The combining of waveform and waveform 2 of FIG. 7 in comparison block 19 of FIG. 6 prior to input into op-amp U3*a* would result in a combined waveform of the form of waveform 3 of FIG. 7. The amplified combined waveform would thereafter be supplied to comparators U4*a* and U4*b*. Given that channel 4 and channel 7 are designated as to be monitored for anti-theft in view of the low values of waveform 2 indicated for the respective channels and that the power distribution channel blocks for channels 2, 4 and 7 have sensed the return injected RF current as indicated by high values of the corresponding sensing outputs SEN as indicated by waveform 1, the combined waveform 3 of FIG. 7 is resultantly of high value for each corresponding channel since the return injected RF current for the monitored channels have been detected.

However, if for some unforeseen reason the return injected RF current corresponding to channel 4, for example, is not detected by the corresponding power distribution channel block and the corresponding sensing output SEN4 assumes a low value, the multiplex return RF signal of waveform 1 of FIG. 7 would assume a low value for channel 4. The resultant combined signal input to amplifier U3*a* of comparison block 19 would correspond to waveform 4 of FIG. 7. Accordingly, in view of the low value corresponding to channel 4, the comparison block 19 would thereafter generate the appropriate corresponding alarm output and display output signals to alarm block 21 and LED drive block 23, respectively, indicative of disconnect of the corresponding electronic equipment.

Figure 8:
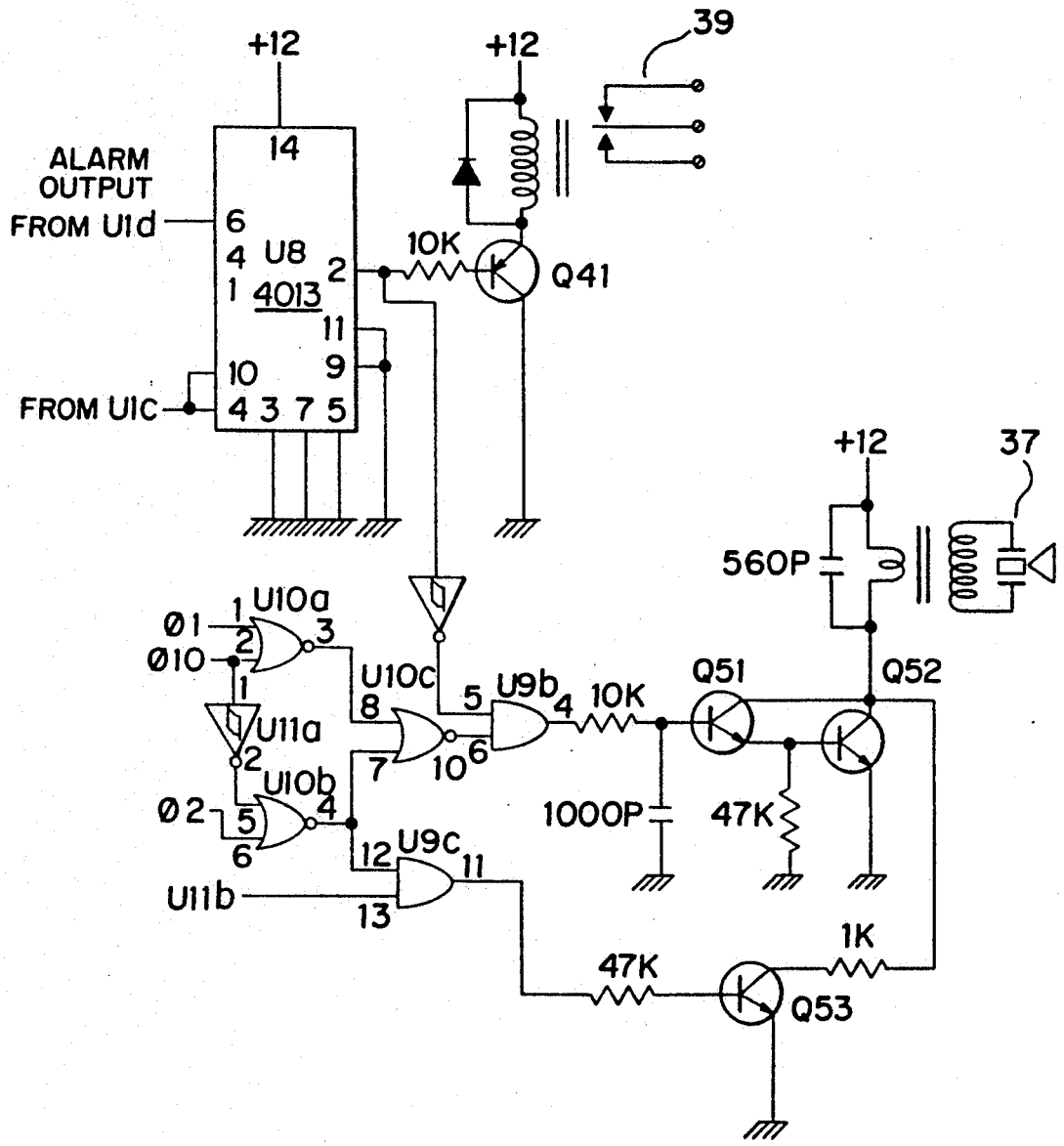
FIG. 8 illustrates the specific details of the alarm block of FIG. 1.

FIG. 8 illustrates the specifics of alarm block 21 of FIG. 1. The piezo driver of the internal piezo speaker 37 is driven by a combination of the output phases $\phi 1$, $\phi 2$ and $\phi 10$ of alarm switch/clock block 17 which are input to NOR gates U10*a* and U10B. The frequency of $\phi 1$ is selected to provide an intermittent tone as output of the piezo speaker 37. The frequency of $\phi 2$ is selected to provide a low frequency tone as output of piezo speaker 37. Furthermore, as illustrated, the alarm output signal from amplifier U1*d* and the output from amplifier U1*c* of comparison block 19 are provided as input to alarm logic chip U8. The corresponding output of alarm logic chip U8 is provided as input to AND gate U9*b* and also input to activate external relay 39, which activates an alarm system located on the premises where the electronic equipment is located.

Figure 9:
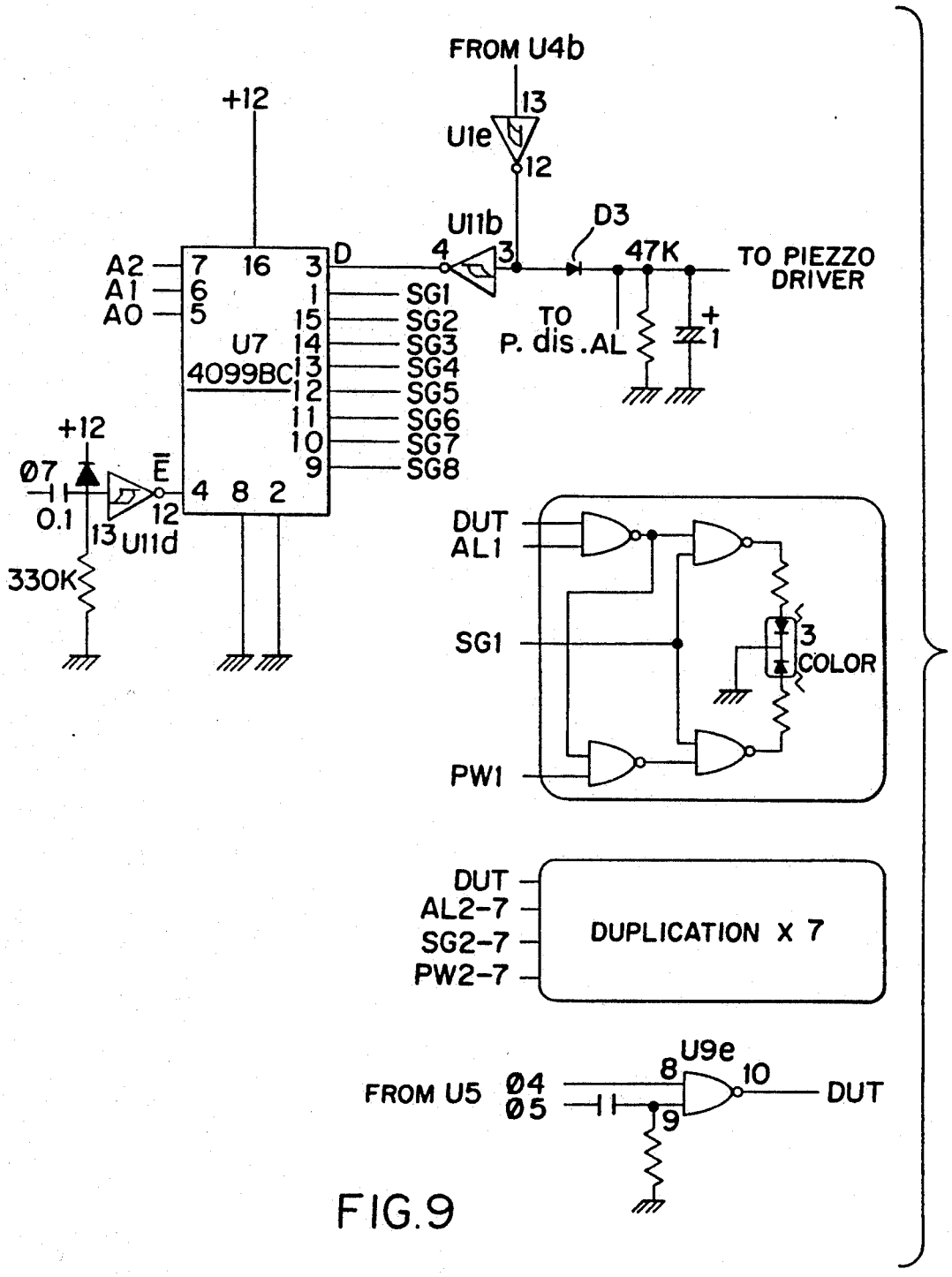
FIG. 9 illustrates the specific details of the LED drive block of FIG. 1.

FIG. 9 illustrates in detail LED drive block 23 of FIG. 1. Coupled to input pin 4 of LED logic chip U7 through amplifier U11*d* and capacitor 41 is clock phase $\phi 7$ output from pin 4 of clock logic chip U5. The LED logic chip U7 is further tied to address signals A0–A2 through the corresponding address lines via pins 5–7. Schmitt trigger U1*e* is supplied with the display output signal from comparison block 19 of FIG. 6 output from comparator U4*b*. The output of Schmitt trigger U1*e* is supplied through diode D3 as the output to the piezo driver of the internal piezo speaker 37 of the alarm block of FIG. 8. Also input subsequent diode D3 is the power disconnect signal AL output from the ground/-power failure detect block 27 of FIG. 1.

Each of the three color LEDs as described above includes drivers as illustrated in the corresponding figures. In order to produce flashing LEDs, signal DUT is output from NAND gate U9*e* as illustrated in response to clock signals $\phi 4$ and $\phi 5$ from clock logic chip U5 of the alarm switch/clock block 17. Signals SG1–7 are generated as output of LED logic chip U7 as illustrated. Signals AL1–8 are output from the switches of alarm switch/clock block 17 as illustrated in FIG. 5. Signals PW1–8 are supplied from the switches accordingly denoted as part of the power distribution channel block illustrated in FIG. 2.

Figure 10:
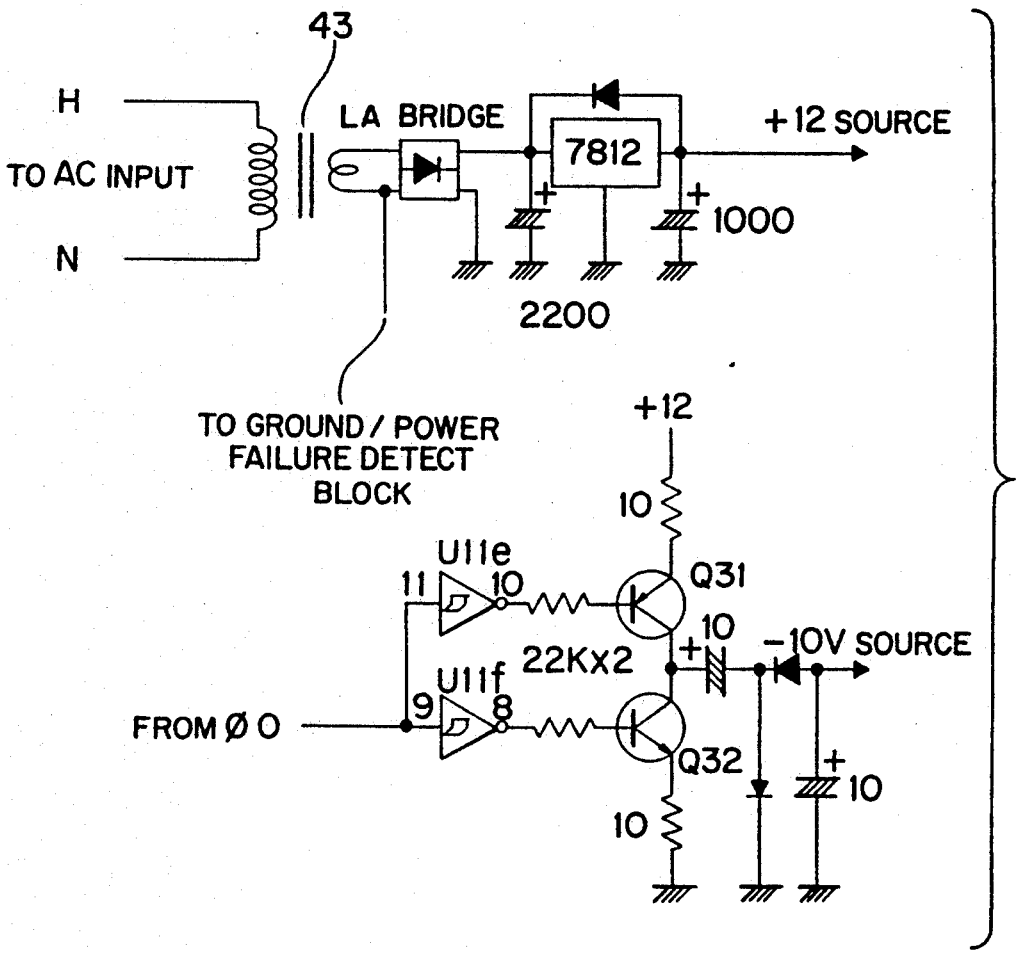
FIG. 10 illustrates the specific details of the power supply block of FIG. 1.

FIG. 10 illustrates the specifics of the power supply block 25 of FIG. 1. As illustrated, ac power lines are coupled to a step-down power transformer 43 which is subsequently coupled to a diode bridge 45 on its secondary side. Tapped off from the secondary side of the step-down power transformer 43 is a line which is supplied to the ground/power failure detect block 27 of FIG. 11. The output of the diode bridge 45 is coupled to regulator 47. The output of the regulator 47 is a +12V supply which is utilized by the system. The lower portion of the power supply block is a power generator which serves to generate a −10V supply for the system as illustrated. Schmitt triggers U11*e* and U11*f* are coupled to the clock phase $\phi 0$ output from clock logic chip U5 of the alarm switch/clock block 17. The Schmitt triggers serve to drive power transistors Q31 and Q32 which generate the −10V supply.

Figure 11:
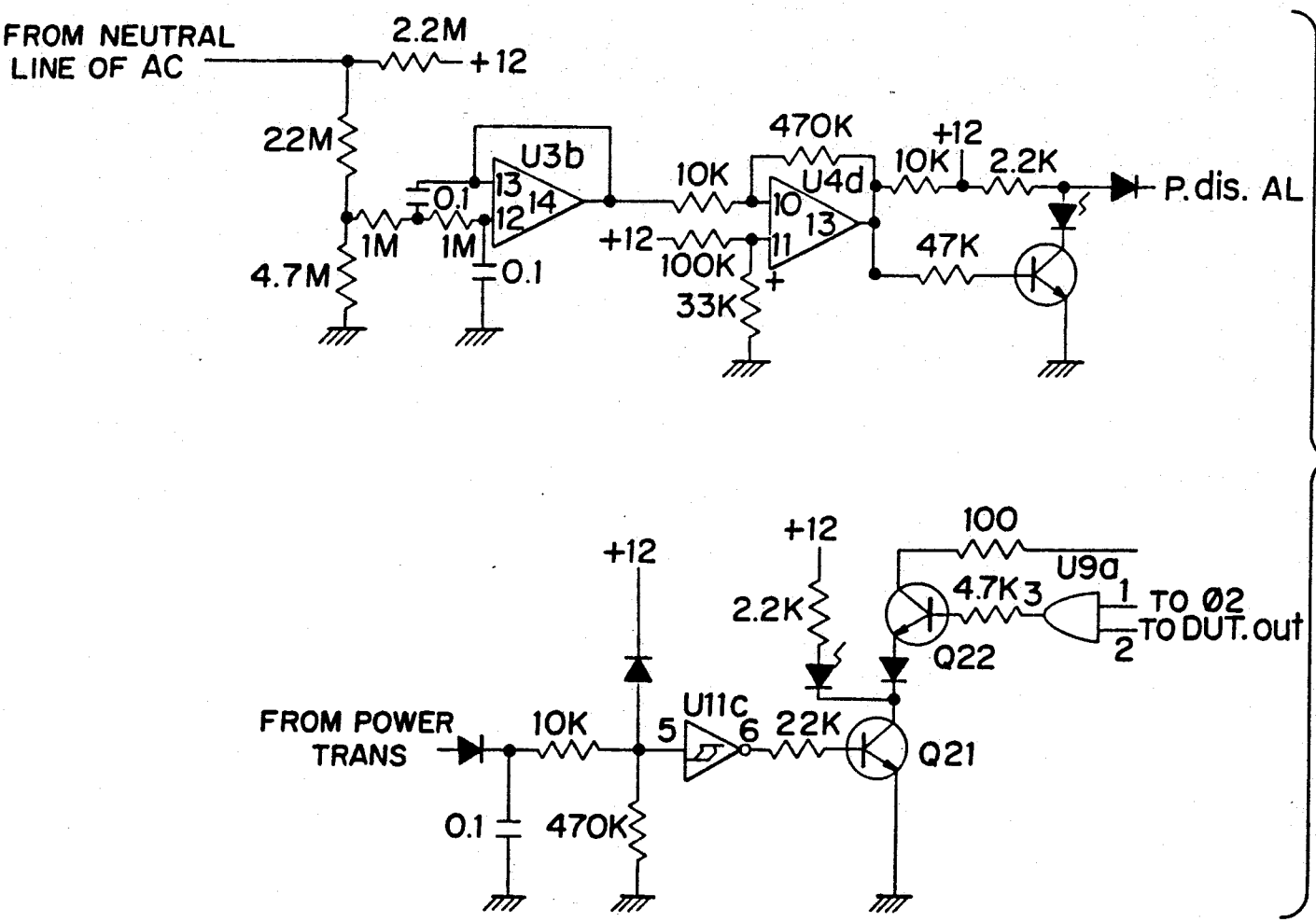
FIG. 11 illustrates the specific details of the ground/-power failure detect block of FIG. 1.
Figure 12:
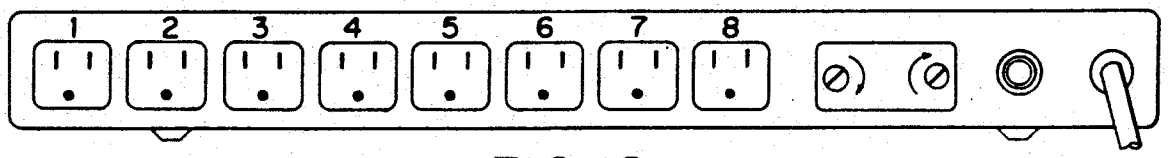
FIGS. 12-15 illustrate various views of the power distribution and anti-theft alarm system housing.

FIG. 11 illustrates the specific details of the ground/-power failure detect block 27 of FIG. 1. A line is tapped off from the neutral line prior to the step down transformer 43 of FIG. 10 and is coupled as input to the upper ground failure detecting portion of the block. Accordingly, op amps U3*b* and U4*d* are utilized to sense the ground line in order to detect discontinuity thereof indicative of removal of the alarm system itself. The 2.2MΩ and 4.7MΩ resistors serve as a divider to inject DC voltage from a neutral line of the AC supply. Op-amp U3*b* is used as a buffer and filter circuit while op-amp U4*d* is utilized as a comparator to indicate when the ground is not at zero. In such an instance, transistor Q101 drives LED 101 to be lit indicative of a "ground open" situation and subsequently, power disconnect signal P.dis AL is generated if any of the above-noted alarm switches have been activated.

The lower portion of the ground/power failure detect block is utilized to sense if the AC power supply is normal. A line is tapped of from subsequent the step-down power transformer 43 and supplied as input to the lower power failure detect portion. When the AC supply is disconnected, the input to Schmitt trigger U11*c* will be low, to thereafter turn transistor Q21 on, lighting LED 102 indicative of power failure. If transistor Q22 is on due to signals $\phi 2$ and DUT.OUT input to logic gate U9*a*, the piezo-speaker will beep at a low tone.

The power distribution and anti-theft alarm system housing is illustrated generally in FIGS. 12–15. The corresponding outlets AC OUT 1–8 are illustrated as is the various LEDs 104 for the corresponding channels. A mode switch is also illustrated and during test mode, the alarm sound is a low tone, i.e. one beep, the external relay is not active, and the system automatically resets thereafter. Also illustrated are respective ground open and power failure LEDs 101 and 102 considered above and test button 103. The alarm switches for the corresponding channels 1–8 are illustrated and are concealed within the key-locked door to prevent tampering.

The thus above-described power distribution and anti-theft alarm system provides for monitoring of electronic equipment of a plurality of channels by injecting RF current along the power supply lines of each channel and sensing the return injected RF current returned through existing frontend noise suppressor capacitors. Accordingly, cutting or removal of the power cord can be determined through evaluation of the return injected RF current signal to provide alarm indication in the event of tampering with the electronic equipment.

Since the existing front-end noise suppressor capacitors of the electronic equipment are located before power switches of the equipment, the injected RF current will traverse the front-end noise suppressor capacitors before the switch and thereafter be returned to the source. Accordingly, the system advantageously operates whether the electronic equipment is in an active state or an inactive state.

As illustrated, the power distribution and anti-theft alarm system is constructed in the manner of a power distribution box and may ideally be placed in a central location near a computer cluster. The alarm block 21 as illustrated in FIG. 8 may additionally be coupled to any existing external security system, such as a home security system, to ensure further maximum security and anti-theft protection.

In the event that an existing front-end noise suppressor capacitor of an electronic equipment is disposed in a position subsequent that of the power switch of the electronic equipment, the electronic equipment may still be monitored by the power distribution and anti-theft alarm system of the present invention merely by maintaining the power switch permanently active and by controlling the power supply to the electronic equipment by using the main power switches 1–8 of the front panel to regulate power thereof. In the event that any of the electronic equipment does not include existing front-end noise suppressor capacitors, an RF current return apparatus, such as a capacitor, can be coupled in parallel across the power supply lines within the frontend of the electronic equipment.

Figure 16:
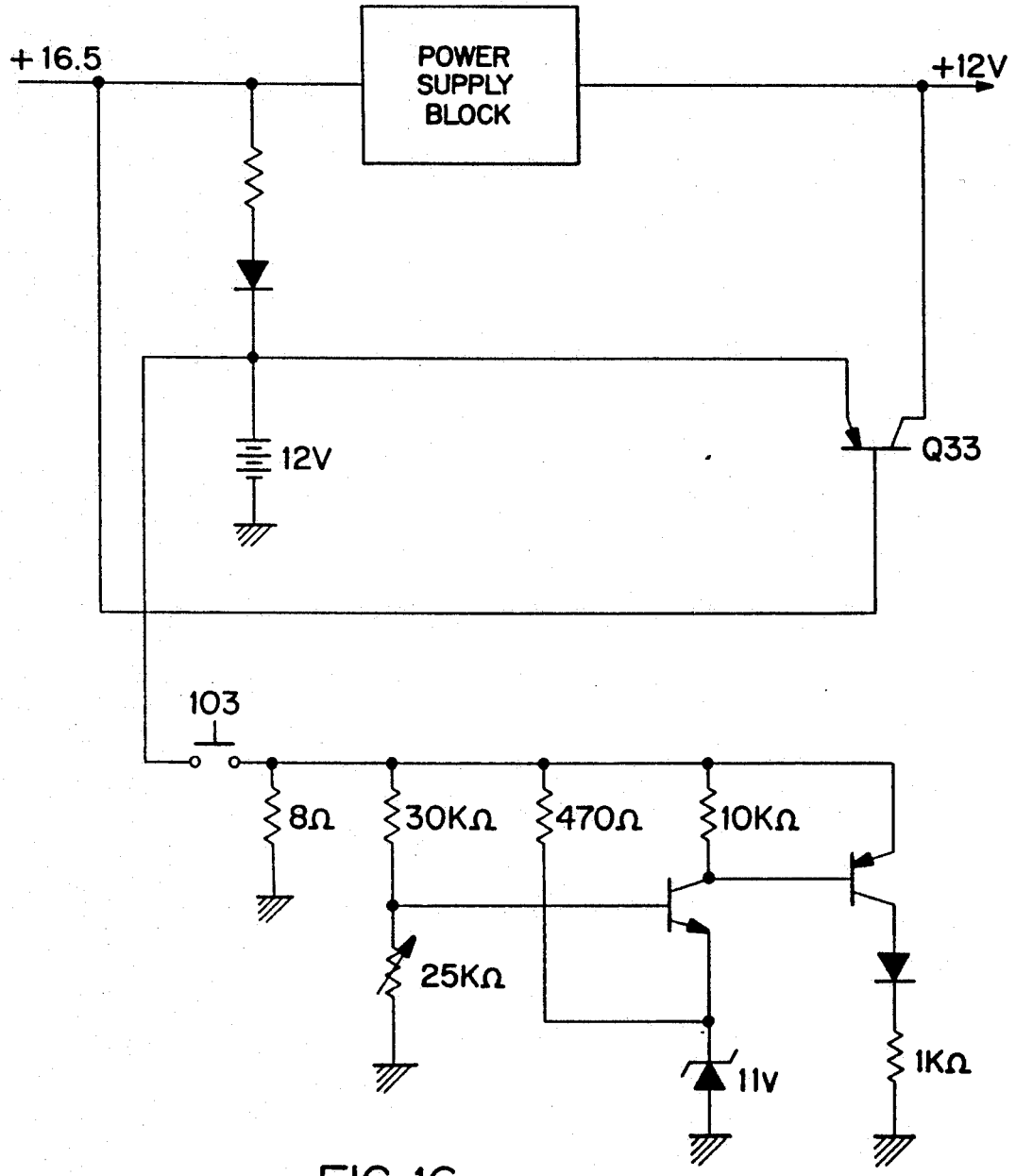
FIG. 16 illustrates an example of a back-up power supply of the power distribution and anti-theft system.

As indicated previously, the system of the present invention is capable of being expanded to monitor additional channels as a result of the various multiplexers and the clock logic chip U5 which provides synchronizing signals corresponding to the various channels monitored. Additionally, a back-up power supply, as illustrated in FIG. 16, allows for monitoring even in the event of a general power failure. As illustrated in FIG. 16, transistor Q33 is included which is turned on in the event of a power failure so that the 12V battery serves to supply power to the system. Once power is restored, transistor Q33 is turned off to switch the battery out of the supply line. During this time, the battery is recharged. Switch 103 serves as a test mode switch for providing visual evidence that the back-up battery is charged.

The invention being thus described, it will be obvious that the same may be varied in many ways. For instance, various different combinations of illuminated LEDs may be utilized to provide indication of the status of the monitored channels. Furthermore, channel status and the alarm condition may be indicated by various other visual or audio warnings. Additionally, the values of the various capacitors, resistors and elements of the present invention are exemplary only and are not to be considered as limiting. Such variations of the present invention are not to be regarded as a departure from the spirit and scope of the invention, and all such modifications as would be obvious to one skilled in the art are intended to be included within the scope of the following claims.

What is claimed is:

1. A method of monitoring electronic equipment, the electronic equipment being coupled to power supply lines and including a front-end noise suppressor connected in parallel across the power supply lines, comprising the steps of:

injecting an RF current through the power supply lines to the electronic equipment;

monitoring the power supply lines to detect the injected RF current returned from the front-end noise suppressor of the electronic equipment; and generating an alarm signal indicative of disconnect of the electronic equipment from the power supply lines if the return injected RF current is not detected.

2. A power distribution and alarm system, for use with a plurality of electronic equipment which include front-end noise suppressors, comprising:

RF generating means for generating an RF current;

power distribution means, coupled to said RF generating means, for supplying power along power supply lines to the electronic equipment, said RF current being injected into the power supply lines;

detection means, coupled to said power supply lines, for detecting said injected RF current returned from the electronic equipment through the front-end noise suppressors; and alarm means, coupled to said detection means, for generating an alarm signal indicative of disconnect of said power supply lines from the electronic equipment when said return injected RF current is not detected by said detection means.

3. The power distribution and alarm system of claim 2, the front-end noise suppressors being capacitors coupled in parallel across said power supply lines.

4. The power distribution and alarm system of claim 2, said RF generating means comprising:

oscillator means, coupled to a power source, for generating an RF signal; and amplifier means, coupled to said oscillator means, for amplifying said RF signal to generate said RF current.

5. The power distribution and alarm system of claim 4, said RF current being 120 KHz.

6. The power distribution and alarm system of claim 2, said power distribution means comprising:

RF choke means, coupled to an AC main power supply, for preventing said injected RF current from passing towards said AC main power supply;

toroid coil means, coupled to said RF choke means, for coupling said injected RF current with power from said AC main power supply to generate the supplied power; and injection means, coupled to said RF generating means, for injecting said RF current into said toroid coil means.

7. The power distribution and alarm system of claim 6, said injection means comprising a capacitor.

8. The power distribution and alarm system of claim 6, said RF choke means comprising an inductor.

9. The power distributor and alarm system of claim 6, said toroid coil means comprising a two-turn primary coil for coupling said injected RF current with said power from said AC main power supply.

10. The power distribution and alarm system of claim 9, said detection means comprising a secondary coil of said toroid coil means which detects existence of said return injected RF current by detecting existence of said injected RF current which is measurable when a complete return path is provided for said injected RF current along said power supply lines through the front-end noise suppressors back to said power distribution means.

11. A unitary housed power distribution and alarm system for supplying power to and providing anti-theft monitoring of a plurality of electronic equipment over a plurality of channels, each of the electronic equipment including a front-end noise suppressor capacitor, comprising:

power distribution means, coupled to the electronic equipment through the plurality of channels, for supplying power thereto;

RF signal generation means, coupled to said power distribution means, for generating an RF current to be injected into the power supplied to the electronic equipment via the plurality of channels;

switch means for generating a switch signal indicative of which of the plurality of channels is to be monitored for anti-theft of the electronic equipment;

detection means, coupled to said power distribution means, for detecting said injected RF current returned through the front-end noise suppressor capacitors of the electronic equipment via the plurality of channels; and alarm means, coupled to said switch means and said detection means, for generating an alarm signal indicative of disconnect of a particular one of the plurality of channels from the electronic equipment when said return injected RF current of the particular channel is not detected by said detection means and the particular channel is monitored for anti-theft.

12. The unitary housed power distribution and alarm system of claim 11, said power distribution means comprising a plurality of power blocks, one for each respective plurality of channels, each comprising:

RF choke means, coupled to an AC main power supply, for preventing said injected RF current from passing towards said AC main power supply; and toroid coil means, coupled directly to said RF choke means and coupled to said RF signal generation means through a capacitor, for coupling said injected RF current with power from said AC main power supply to generate the supplied power.

13. The unitary housed power distribution and alarm system of claim 12, each of said toroid coil means comprising a primary coil for coupling said injected RF current with said power from said AC main power supply.

14. The unitary housed power distribution and alarm system of claim 13, said detection means comprising secondary coils of said toroid coils which detect existence of said return injected RF current when a complete return path is provided for said injected RF current along respective ones of the plurality of channels through the front-end noise suppressor capacitors back to said power distribution means.

15. The unitary housed power distribution and alarm system of claim 11, said alarm means comprising a plurality of multi-color LEDs, one for each channel, for generating said alarm signal and signals indicative of monitored channels and non-monitored channels.

16. The unitary housed power distribution and alarm system of claim 11, said switch means comprising a plurality of DIP switches.

17. The unitary housed power distribution and alarm system of claim 12, said power distribution means comprising a plurality of electrical outlets for coupling said power from said AC main power supply to the electronic equipment through power cords.

18. A method of monitoring electronic equipment for anti-theft through power distribution lines comprising the steps of:

coupling an RF current return means, to a front-end of the electronic equipment, in parallel across the power distribution lines;

injecting an RF current into the electronic equipment through the power distribution lines;

monitoring the power distribution lines to detect the injected RF current returned from the electronic equipment through the RF current return means; and generating an alarm signal indicative of disconnect of the electronic equipment from the power distribution lines when the return RF injected current is not detected.

19. The method of monitoring electronic equipment of claim 18, said step of coupling comprising coupling a capacitor across the power distribution lines.

20. The method of monitoring electronic equipment of claim 18, the RF current being 120KHz.

* * * * *